US007357062B2

(12) United States Patent
Joynt

(10) Patent No.: US 7,357,062 B2
(45) Date of Patent: Apr. 15, 2008

(54) MINE RESISTANT ARMORED VEHICLE

(75) Inventor: Vernon P. Joynt, Pretoria (ZA)

(73) Assignee: Force Protection Industries, Inc., Ladson, SC (US)

( * ) Notice: Subject to any disclaimer, the term of this patent is extended or adjusted under 35 U.S.C. 154(b) by 0 days.

(21) Appl. No.: 11/401,269

(22) Filed: Apr. 11, 2006

(65) Prior Publication Data

US 2007/0234896 A1 Oct. 11, 2007

(51) Int. Cl.
*F41H 7/04* (2006.01)
*B60R 27/00* (2006.01)

(52) U.S. Cl. ..... 89/36.08; 296/193.07

(58) Field of Classification Search ..... 89/36.02, 89/36.07–36.12, 36.16, 40.01, 40.03; D12/3, D12/12, 301; 180/311, 312, 69.1; 296/38, 296/193.07, 204

See application file for complete search history.

(56) References Cited

U.S. PATENT DOCUMENTS

D142,247 S * 8/1945 Hill ..... D12/3
D143,365 S * 12/1945 Sutphen ..... D12/3
D144,344 S * 4/1946 Alexander ..... D12/12
D164,216 S * 8/1951 Baldin ..... D12/12
3,176,585 A * 4/1965 Ruf ..... 89/36.08
3,720,280 A * 3/1973 Eiler ..... 180/292
4,158,986 A * 6/1979 Appelblatt et al. ..... 89/36.08
4,174,653 A * 11/1979 Appelblatt ..... 89/36.08
4,280,393 A * 7/1981 Giraud et al. ..... 89/36.08
4,326,445 A * 4/1982 Bemiss ..... 89/36.08
4,492,282 A * 1/1985 Appelblatt et al. ..... 180/68.1
6,435,071 B1 * 8/2002 Campbell ..... 89/36.08
2005/0257679 A1 * 11/2005 Hass et al. ..... 89/36.09

* cited by examiner

*Primary Examiner*—Bret Hayes
(74) *Attorney, Agent, or Firm*—Finnegan Henderson Farabow Garrett & Dunner LLP

(57) ABSTRACT

A blast-resistant armored land vehicle that may include a monocoque body comprised of sheet material with the bottom portion of the vehicle being substantially V-shaped. The apex of the V is substantially parallel with the centerline of the vehicle with the tip of the V having a radius of approximately 1-4 inches. The angle of the V may be approximately 115°-130°. The vehicle has a ground clearance of greater than 30 inches. The vehicle further includes an engine detachably affixed within the body, a transmission connected to the engine, a transfer case connected to the transmission having a front output shaft and a rear output shaft. The transfer case may be located at the approximate the fore and aft center of the vehicle and may be enclosed within a blast resistant that includes sheet material above the transfer case. The drive train may be connected to the engine and may be detachably affixed to the body.

25 Claims, 10 Drawing Sheets

MINE RESISTANT ARMORED VEHICLE

FIELD OF THE INVENTION

The present invention relates to an armored motor vehicle and especially one that is resistant to land mines and improvised explosive devices deployed adjacent the path of the motor vehicle.

BACKGROUND OF THE INVENTION

Conventional armored motor vehicles attempt to moderate the effect of mines and explosive devices by using armor of a thickness that will not be penetrated by penatrators, soil, rocks or the like, or by the blast from such a mine or explosive device. Such vehicles generally have bottom surfaces parallel to the surface on which they ride, side surfaces perpendicular to the surface on which they ride and relatively low ground clearance. In addition, front and rear wheel wells, front and rear drive assemblies, and front and rear wheels are typically positioned with respect to the vehicle body in substantially the same location as on a non-armored motor vehicle.

When such vehicles detonate an anti-vehicle mine below the vehicle, a penetrator and/or debris above the mine are propelled upward. If the vehicle has a relatively low ground clearance it confines the energy from the explosive blast beneath the vehicle and, as a result, the energy from the mine blast is efficiently transferred to the bottom of the vehicle. This can result in the mine defeating the armor and allowing the penetrator, debris or the blast energy to breach the armor and enter the vehicle. If the bottom of the vehicle is higher above the surface on which the vehicle runs (i.e., the vehicle has a higher ground clearance) more of the blast energy could dissipate in the space above the ground before encountering the bottom of the vehicle. A large ground clearance significantly reduces the amount of energy impinging on the bottom of the vehicle and reduces the efficiency of energy being transferred to the vehicle at locations distant from the detonation point of the mine.

In addition, some portion of the blast energy (depending on the depth of the mine and the configuration of the blast) is directed with a lateral component. The greater the ground clearance of the vehicle, the greater probability that a portion of the blast traveling laterally will not encounter the vehicle. Even if some of the debris and blast moving laterally encounter portions of the bottom of the vehicle they are traveling at a small angle to the surface of the bottom. Thus, the energy and debris is more likely to deflect from the surfaces that they encounter rather than transfer its energy to them.

Moreover, if the bottom of the vehicle is flat and parallel to the ground, much of the energy of the mine and any material propelled by it hits the bottom surface perpendicular to its surface. As a result the energy of the material and the blast is most efficiently transferred to that surface and the probability that the armor bottom will be defeated and breached is maximized.

In order to produce maximum probability that a mine will breach the armor of a vehicle, the blast may be designed to be focused and directed in a specific direction. Normally an anti-vehicle mine directs its blast in an upward-projecting cone, with the apex of the cone in the ground, and the base of the cone striking the vehicle. This is accomplished by shaping the explosive charge, providing a directed cavity to direct the initial blast, and the inherent guidance of the blast resulting from the mine being surrounded on all but the top surface with the mass of the earth in which it is buried. As such, a normal blast will propel gas and solid material over the mine in a cone describing an angle of approximately 60°. If, however, the mine detonates directly underneath the wheel or track of a vehicle, more of the blast energy is deflected laterally.

In irregular or guerilla warfare, explosive devices often are fabricated from any available explosive materials and may not have the trigger mechanisms of manufactured anti-vehicle mines. These irregular devices are commonly referred to as "roadside bombs" or "improvised explosive devices" or "IEDs." It may not be practicable to take the time to bury such devices in the anticipated path of vehicles to be attacked. Such devices are many times simply disguised and placed adjacent the path of the vehicle. They are then detonated when the target vehicle is adjacent the device. As a result, the blast and material propelled by it tend to impinge laterally on the side of the target vehicle.

If the side of the target vehicle adjacent the exploding device is flat, much of the energy of the blast and any material propelled by it hits the side surface perpendicularly. As a result, the energy of the material and the blast energy is efficiently transferred to the surface, and the probability that armor on the sides of the vehicle will be defeated and breached is increased.

While any practical mine or improvised explosive device can be defeated by armor of sufficient strength and thickness, the extra armor is heavy and expensive, adds weight to the vehicle which, in turn places greater strain on the vehicle engine, and drive train.

Thus, there exists a need for an armored vehicle that can survive detonation of anti-vehicle mines and improvised explosive devices without requiring excess thicknesses of armor. Preferably, such armor would be made of material that can be readily fabricated and incorporated into the vehicle design at a reasonable cost.

SUMMARY OF THE INVENTION

To achieve these and other goals of the invention, there is provided an armored vehicle that is resistant to damage from blasts and material from mines and improvised explosive devices. The vehicle may include an engine and a drive train. In a preferred embodiment the vehicle is a 4×4 configuration having a front wheel drive assembly and a rear wheel drive assembly.

The vehicle further may include a monocoque body comprised of sheet material. The engine and drive train are operatively and detachably affixed to the body. The front wheel drive assembly may be located as far forward on the vehicle as is operationally practicable, proximate the front end of the vehicle and the rear wheel drive assembly may be located as far to the rear on the vehicle as is operationally practicable proximate the rear end of the vehicle. The vehicle body has a bottom, and two opposite sides. The bottom of the body is generally V-shaped with the apex of the V being substantially parallel to the approximated centerline of the vehicle. The tip of the V has a radius in the range of from 1 to 4 inches. The angle of the V may be in the range of from approximately 115° to 130°. The body has a ground clearance, as measured from the apex of the V to the surface on which the vehicle rests, of greater than 30 inches.

It is preferred that the sheet armor of the body consists essentially of metal selected from the group consisting of steel, titanium alloys, and aluminum alloys.

It is further preferred that the angle of the V be a compound angle, having more than a single angle, with the angle of the V closest to the centerline of the vehicle being greater than the angle of the V adjacent the sides of the body. A most preferred embodiment has the angle of the V closest to the centerline approximately 120°, and the second angle approximately 90°.

Another preferred embodiment of the vehicle has a ground clearance of approximately 3 feet.

Still another preferred embodiment has the engine and drive train of the vehicle being the engine and drive train of a commercial heavy truck.

DESCRIPTION OF THE PREFERRED EMBODIMENTS

Reference will now be made in detail to the present preferred embodiments of the invention, examples of which are illustrated in the accompanying drawings.

In accordance with the invention, there is provided a blast-resistant armored land vehicle that may include a monocoque body comprised of sheet material. In the context of the present invention the phrase "blast-resistant" means that the vehicle is particularly resistant to penetration by either the blast energy or material propelled by the blast energy from either a land mine that explodes beneath the vehicle or an explosive device that explodes laterally, in a generally horizontal direction. In the context of the present invention the phrase "land vehicle" means a vehicle intended primarily to propel itself on the surface of the ground. In the context of the present invention the word "monocoque" means a shell of sheet material joined with either welds, adhesives, fasteners, or combinations thereof to form a vehicle body that is structurally robust enough to eliminate the need for a separate load-bearing vehicle frame on which a body, engine, and drive train would normally be attached. In the context of the present invention, the word "adhesive" means material that strengthens after its initial application to join two solid pieces. Such a material can be a conventional adhesive (a liquid that solidifies or cross-links to bond materials in contact therewith) or in the case of a composite sheet armor, layers of like material at the juncture of two sheets of the composite disposed to join them.

Figure 1:
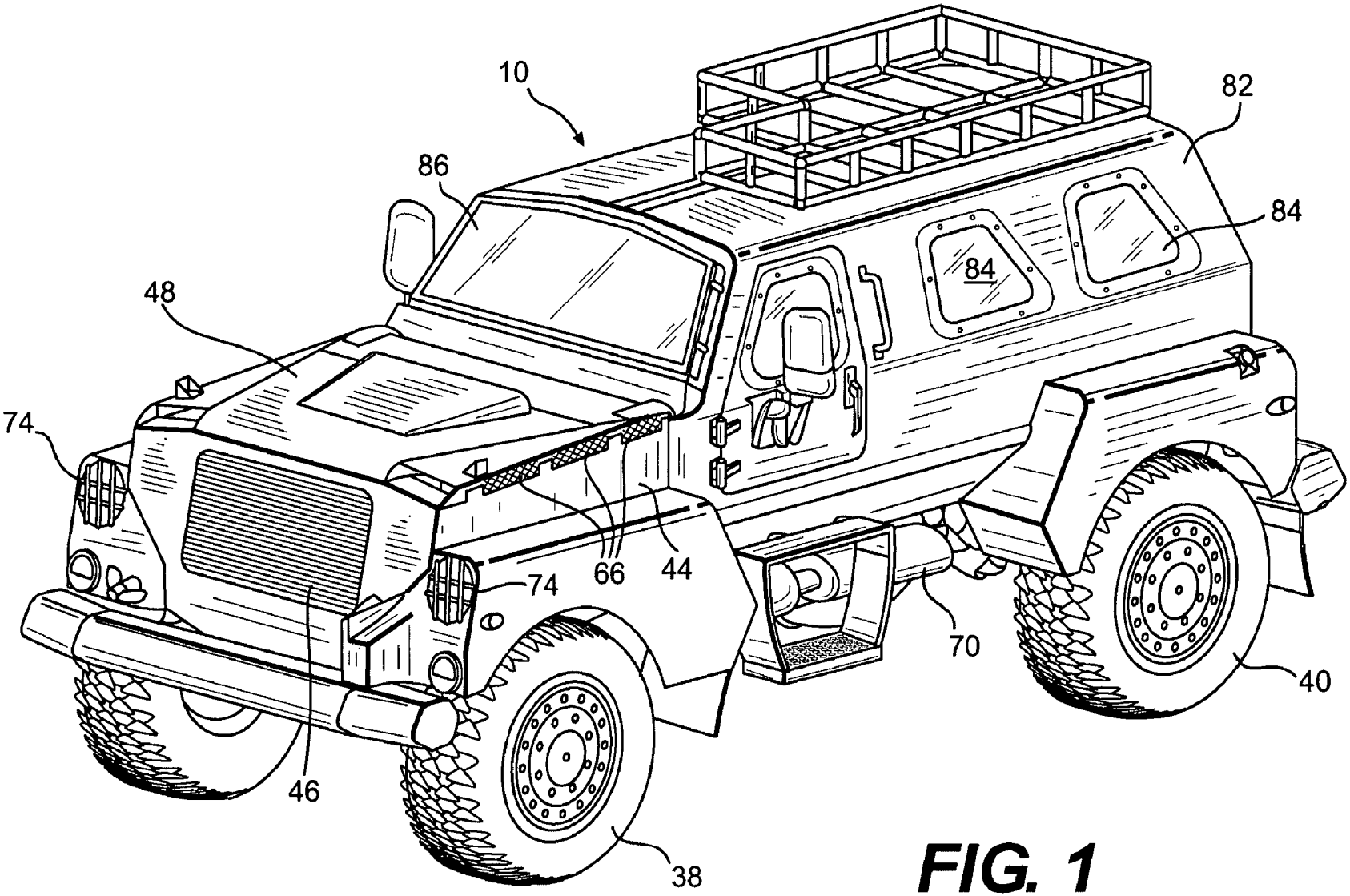
FIG. 1 is a perspective view of one embodiment of the present invention.
Figure 5:
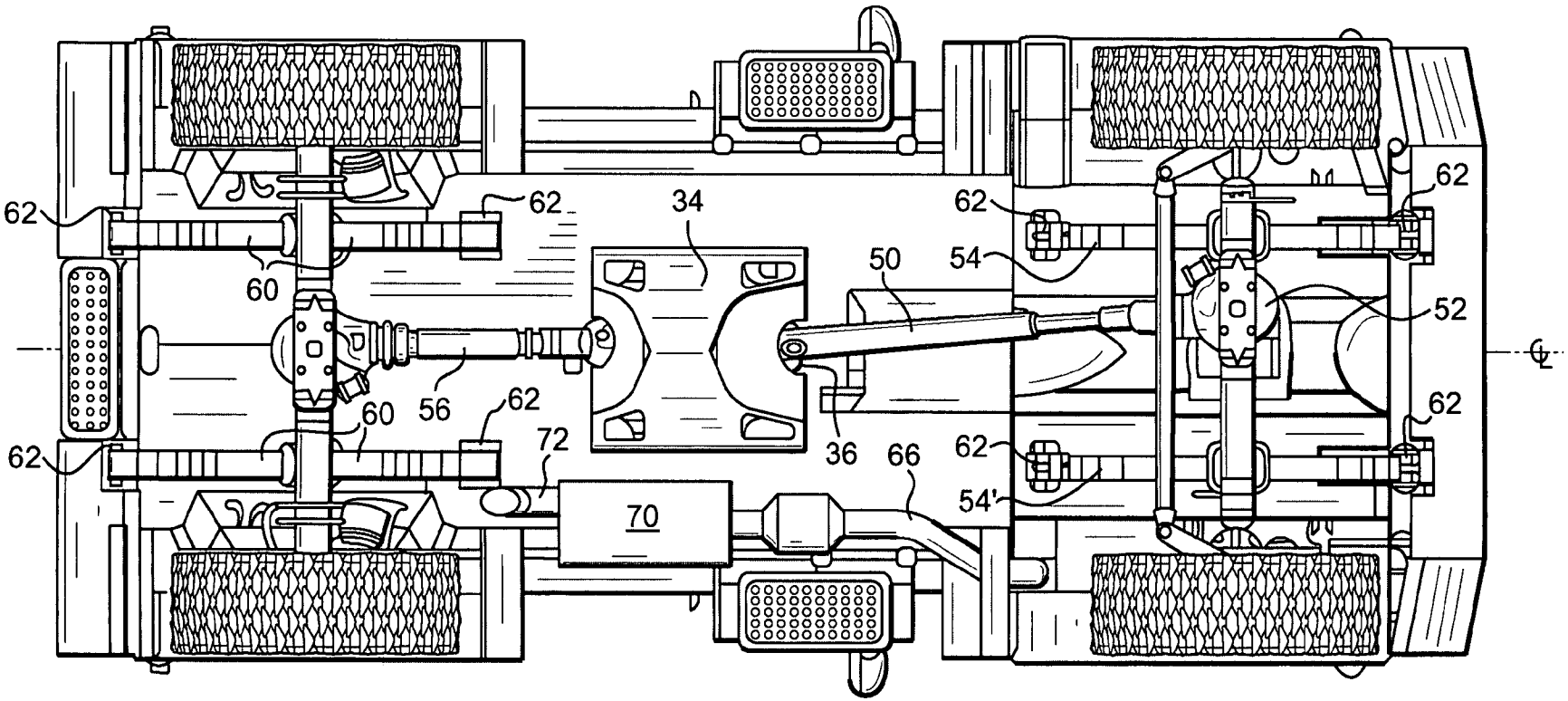
FIG. 5 is a bottom view of a preferred embodiment of the invention.
Figure 9:
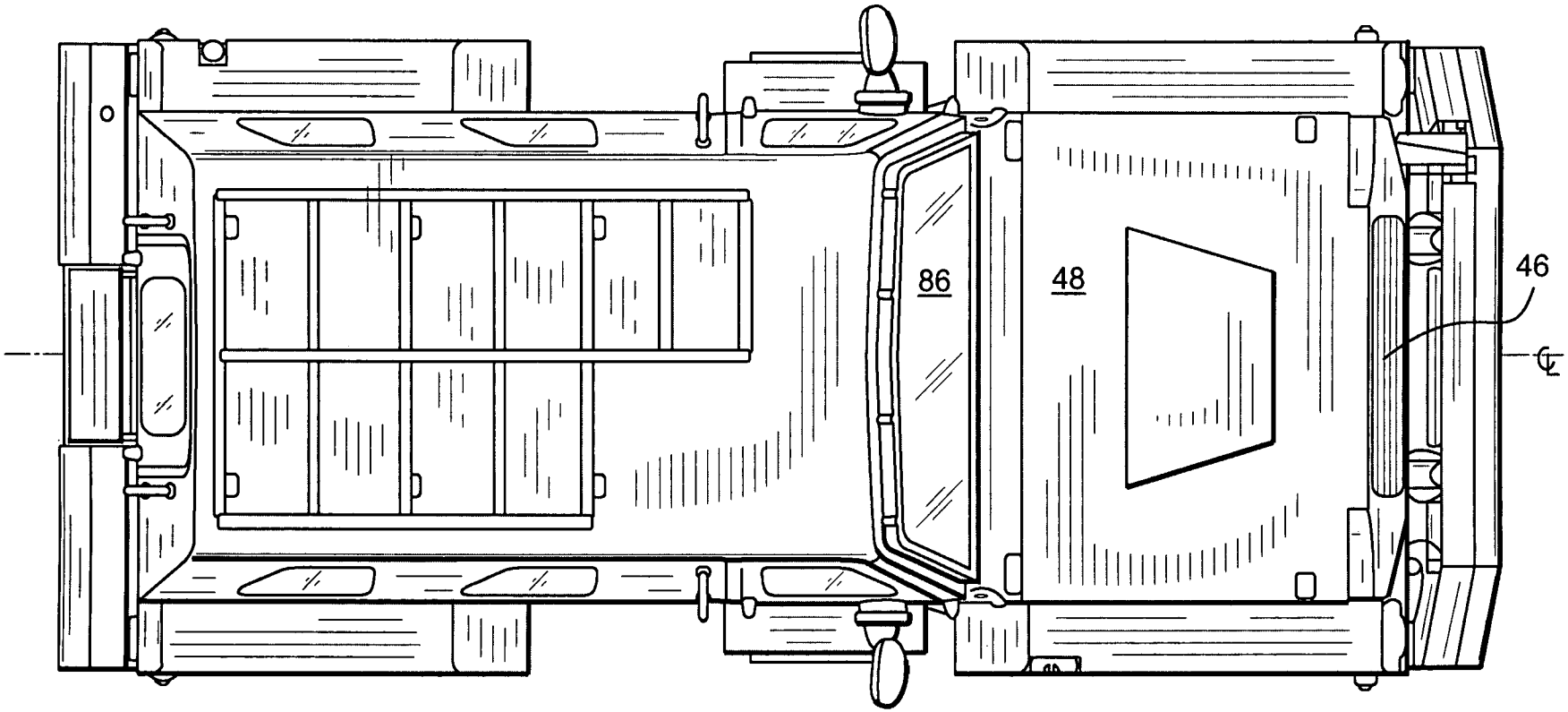
FIG. 9 is a top view of a preferred embodiment of the invention.

As here embodied, and depicted in FIG. 1, the vehicle 10 may include a body 12 formed of sheet materials with a front end 14, a rear end 16, a bottom portion 18, a top portion 20, right side portions 22, left side 22', and a centerline (shown as CL in FIGS. 5 and 9) along the front-to-rear axis of the vehicle 10 approximately half way between the right and left sides of the vehicle.

In a preferred embodiment the sheet material used to form the body 12 may be at least two different sheet materials. In the embodiment depicted the portion of the body 12 that comprises the V-shaped portion 24, here a "double-chined" V, may be formed of a tough sheet material. As used herein the word "tough" is a material that resists the propagation of a crack therethough, generally referred to as a material that has a high fracture toughness. As here embodied the bottom portion 18 (comprising the V shaped portion 24) is preferably sheet steel known as "ROQ-tuf AM700 (a product of Mittal Steel, East Chicago, Ind.). Another material known as SSAB Weldox (a product of SSAB Oxelösund of Oxelösund, Sweden) is also preferred as the material for the bottom portion 18. The upper portion 20 of the body 12 is preferably formed of armor plate. A particularly preferred material is known as SSAB Aronox (a product of SSAB Oxelösund of Oxelösund, Sweden) although an armor meeting U.S. MIL-A-46100 will be operable. Generally, the sheet material preferably consists essentially of a metal selected from the group consisting of: steel, steel armor, titanium alloys, and aluminum alloys. Another preferred embodiment has sheet material may be comprised of fiber reinforced polymers and/or metal matrix composites. In still another embodiment, combinations of metals, fiber reinforced polymers, and composites can be used.

Metal plate is preferred because it has sufficient resistance to penetration, it is relatively inexpensive, it can be formed into the configuration of the present invention without expensive tooling, and it can be joined by welding to form strong, penetration resistant joints. In a preferred embodiment, the sheet material may be in the form of rolled plates which are formed into portions of the body then welded to form the body of the vehicle.

In a preferred embodiment where a hard (and thus relatively brittle) armor material is used for the upper portion of the body and a tough material may be used for the bottom portion of the body, it is preferred that there be a lap joint at the juncture of the two materials with the tough material being on the outside of the hard armor material. As here embodied, and depicted in FIG. 3B, the lower edge 23 of the armor plate forming the upper portion 20 of the body 12 is inside the lap joint that joins the upper edge 25 of the V-shaped lower portion 24.

Figure 2:
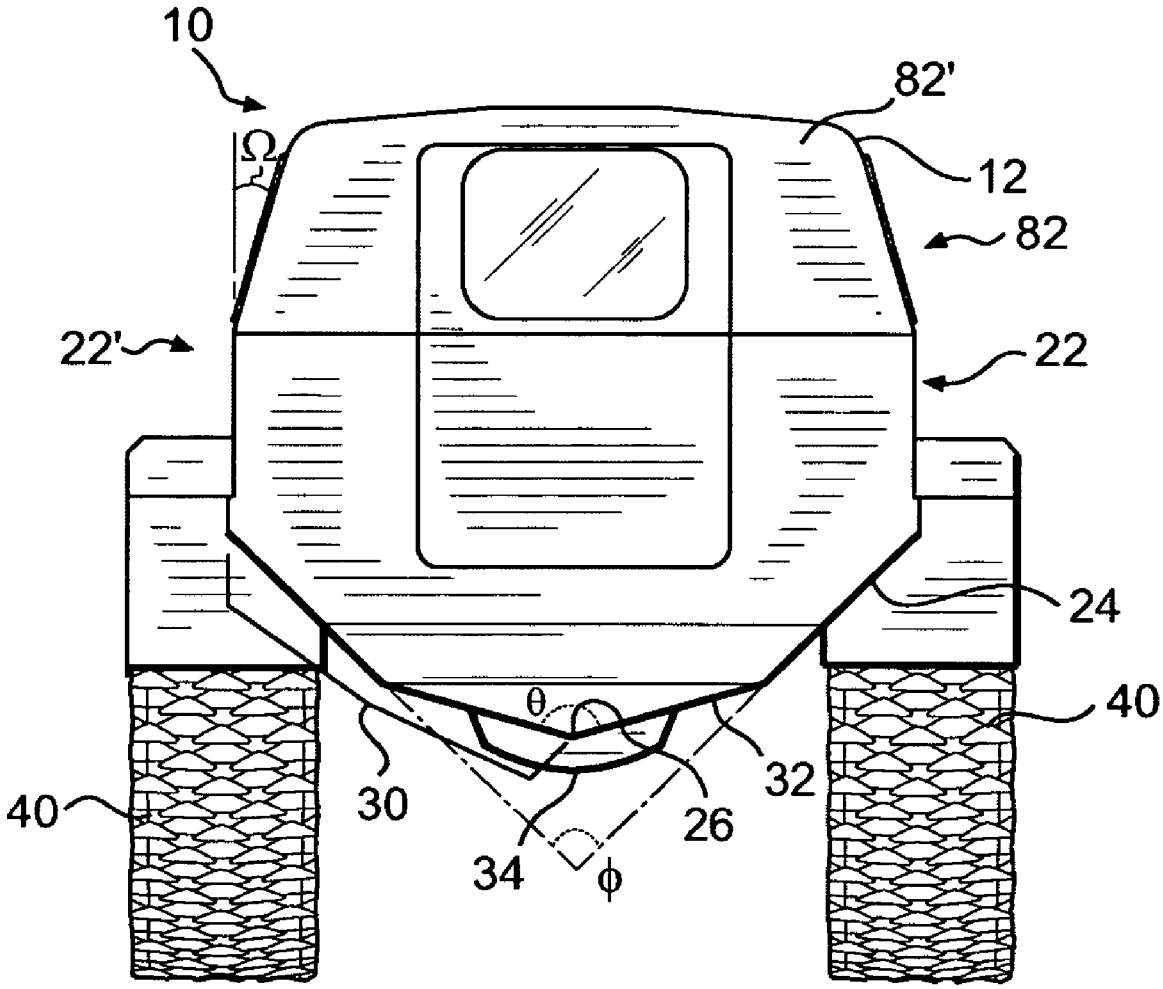
FIG. 2 is schematic rear view depicting one preferred configuration of the vehicle body.

In accordance with the invention, the bottom portion of the vehicle has a V-shape, with the apex of the V directed downward, As here embodied and depicted in FIG. 2, bottom portion 18 defines a V 24, extending the length of the vehicle 10, having an apex (the narrowest, pointed end of the V) 26 extending substantially parallel to the centerline. Preferably the angle of the V 26 (shown as Θ in FIG. 2) may be within a range of from 115° to 130°, and most preferably 120°. When the angle Θ is significantly greater than 130° blast energy directed upward from beneath the vehicle will more efficiently transfer to the bottom portion of the vehicle. When the angle is significantly less than 115° blast energy directed laterally from beside the vehicle will more efficiently transfer to the side portion of the vehicle. The apex of the V-shaped tip 26 will preferably have a radius in the range of from 1 to 4 inches. When the tip radius is less than 1 inch the apex of the V 26 may crack during the bending to form the V. When the tip radius is greater than 4 inches blast energy and associated material directed upward from beneath the vehicle will more efficiently transfer to the bottom portion 18 of the vehicle.

In accordance with the invention, the apex of the V may be at least 30 inches above the surface of the land on which the vehicle operates. As here embodied the vehicle 10 has a ground clearance (the distance above surface of the land on which the vehicle operates, shown as h' in FIG. 6) as measured from the lowest extremity (the apex 26 of the V 24) of the V-shaped bottom 18 of the vehicle 10. Increasing the ground clearance significantly reduces the effect of vertically directed blast energy and material from a buried mine because the blast profile is generally conical with an included angle of about 60°. Thus, the greater the ground clearance, the greater dispersion of the blast energy and material. In addition, a high ground clearance, especially in combination with a V-shaped lower portion of the vehicle also effectively reduces the effect of laterally directed blasts. If, however, the ground clearance is excessive, the vehicle may have an excessively high center of gravity, and if the vehicle width is not able to be increased, there may be risk of rollover if the vehicle it turned at too sharp a radius at too high a speed. As here embodied the vehicle 10 has a ground clearance h' for the vehicle of up to approximately three feet.

In certain preferred embodiments, an energy-absorbing buffer can be attached to apex of the V. As here embodied and depicted if FIG. 3B, the apex 26 may include a metal pipe 28 extended longitudinally inside the apex 26 of the V 24. The pipe 28 may be fastened, preferably by welding, to the interior of the V 24 and it is preferably comprised of a relatively heavy metal. Most preferably, the metal is steel because of its cost and the ease with which it can be joined to a steel body by welding. The presence of the metal pipe at the apex of the V substantially increases the resistance of the body to penetration at the apex of the V by providing a medium that absorbs large amounts of energy at the location in the body receiving the most energy from a blast from beneath the vehicle.

The bottom portion 18 of the vehicle is preferably formed of a single sheet of material and bent to form the compound angled, double-chined V shown as 24 in the embodiment depicted in FIG. 2. The angle Θ closest to the centerline of the vehicle 10 is greater than the angle ϕ adjacent the side portions 22 of vehicle 10. The angle Θ of the V-shaped portion 32 closest to the centerline preferably falls within the range of 115°-130°, and is most preferably 120°, while the outer angle ϕ, adjacent the side portions 20 of vehicle 10 is approximately 90°. The compound angle increases the usable interior volume of the body 12, while not significantly increasing its vulnerability to either laterally or vertically directed mine blasts.

As broadly embodied in FIG. 1, vehicle 10 may further include a set of front wheels 38 and rear wheels 40. While the embodiment depicted is a 4×4 (4 wheels total×4 wheels driven), the present invention is not limited thereto. The invention can be used in a 6×6 configuration, or any number or combination of driven and/or non-driven wheels. The invention may also be used for vehicles driven by tracks, or a combination of wheels and tracks.

In the preferred embodiment depicted herein, the front wheels 38 are located proximate the front end 14 of body 12 and rear wheels 40 are proximate vehicle rear end 16, as far forward and as far rearward, respectively, as is operationally practicable. Locating the wheels at the furthest forward and furthest rearward extremities of the vehicle has several advantages. First, the weight of any portion of the vehicle in front of the front axle is applied solely to the front axle which, because of the steering and drive mechanism (in embodiments where the front wheels are driven) are not as structurally robust as an axle assembly without provision for steering. Minimizing weight forward of the front axle reduces the load on the front drive mechanism. Second, weight in front of the front axle reduces load on the rear axle which can affect traction of the vehicle. Third, locating the wheels at the furthest forward and furthest rearward extremities of the vehicle allows the energy and associated material from a mine detonated under the wheels to be directed away from the vehicle. This further minimizes the efficient transmission of blast energy to the body of the vehicle and reduces the damage to the vehicle by blast propelled material.

As here embodied, and depicted in FIGS. 5-9, the vehicle 10 is a 4×4 wheeled vehicle with an engine 42 (shown schematically in FIG. 6), detachably connected to the vehicle 10 within the front portion 14 of the body 12. The engine 42 may be protected on the sides by the sheet armor 44, in the front by an array of slats 46 disposed to deflect projectiles and allow cooling air to pass through a radiator 45 (shown schematically in FIG. 6), on the top by an armored hood 48, and in the rear by a firewall separating the engine 42 from the interior of the vehicle body 12. The material comprising the firewall may be sheet material of a thickness less that the remainder of the body or simply metal plate because any projectiles or blast energy impinging on the firewall must first pass through either the armored sides 44 of the engine compartment or the slats 46, the radiator 45 and the engine 42.

In a preferred embodiment the body 12 surrounding the engine 42 does not include apertures thru the body to provide access to the engine, other than the hood 48. Any such apertures would make the engine more susceptible to damage from mines or IEDs. In a preferred embodiment the vehicle may include engine and transmission mounts that allow the engine and transmission to be removed from the vehicle from the front of the vehicle for maintenance while routine service of the engine and transmission can be accomplished by raising the hood 48.

The engine is preferably a diesel-cycle engine because of the normal advantages of diesel power for relatively heavy vehicles in addition to the fact that diesel fuel is relatively difficult to ignite by an explosive device penetrating the fuel tank. In a preferred embodiment, the engine may be a commercially available diesel engine, although a engine specially developed for the vehicle is operable. The use of a commercially available engine reduces the cost of the vehicle and simplifies the design and manufacturing process because the size and location of ancillary engine components (e.g., engine motor mounts, not shown) can be readily ascertained from the commercial application and engine installation publications available from the engine manufacturer.

As here embodied, the vehicle 10 has a loaded gross weight of approximately 17,000 pounds (with crew and fuel), with an additional payload of 7,000 pounds. It has a cruising range of approximately 750 miles and a top cruising speed of 65 miles per hour. This preferred embodiment is powered by a 6.6 liter diesel engine developing 300 horse power @3,000 revolutions per minute, manufactured by General Motors of Detroit Mich., designated the 6.6. Duramax V8 Turbo-Diesel. In other embodiments, engines with more or less horsepower can be used depending on the intended gross weight of the vehicle, the type of drive (number and type of driven wheels and/or tracks), the intended use (off or on roads), and the desired performance of the vehicle (range, top speed, and acceleration).

As here embodied, the vehicle 10 may include an automatic transmission (not shown) connected to a transfer case 36 by a first drive shaft (not shown). In the embodiment depicted the transmission is an Allison 2500 automatic transmission made by the Allison division of General Motors. The engine and transmission are preferably mounted within the body 10. Preferably the transfer case is as close to the for and aft center of the vehicle as possible. In a preferred embodiment the transfer case 36 may be within a partial enclosure (not shown) that may be open on the bottom, with a top side, right and left sides, and a rear portion constructed of tough sheet material. The enclosure allows the first drive shaft to enter the enclosure and the enclosure is open on the bottom to provide access to the transfer case from the bottom of the vehicle and to allow coupling with the drive train with drive shafts as will be hereinafter described. The enclosure prevents upwardly directed blast energy and blast propelled material from entering the interior of the vehicle as it may be substantially filled with the transfer case and the top sides and back are comprised of substantial sheet material. As here embodied, and most clearly depicted in FIGS. 5, 6, and 8, the transfer case 36 may be mounted to the bottom 18 of the body 12 within the enclosure described above and may be protected with a transfer case armor assembly 34. As here embodied the transfer case is a model MVG-750 transfer case manufactured by Marmon Herrington of Louisville, Ky.

Figure 6:
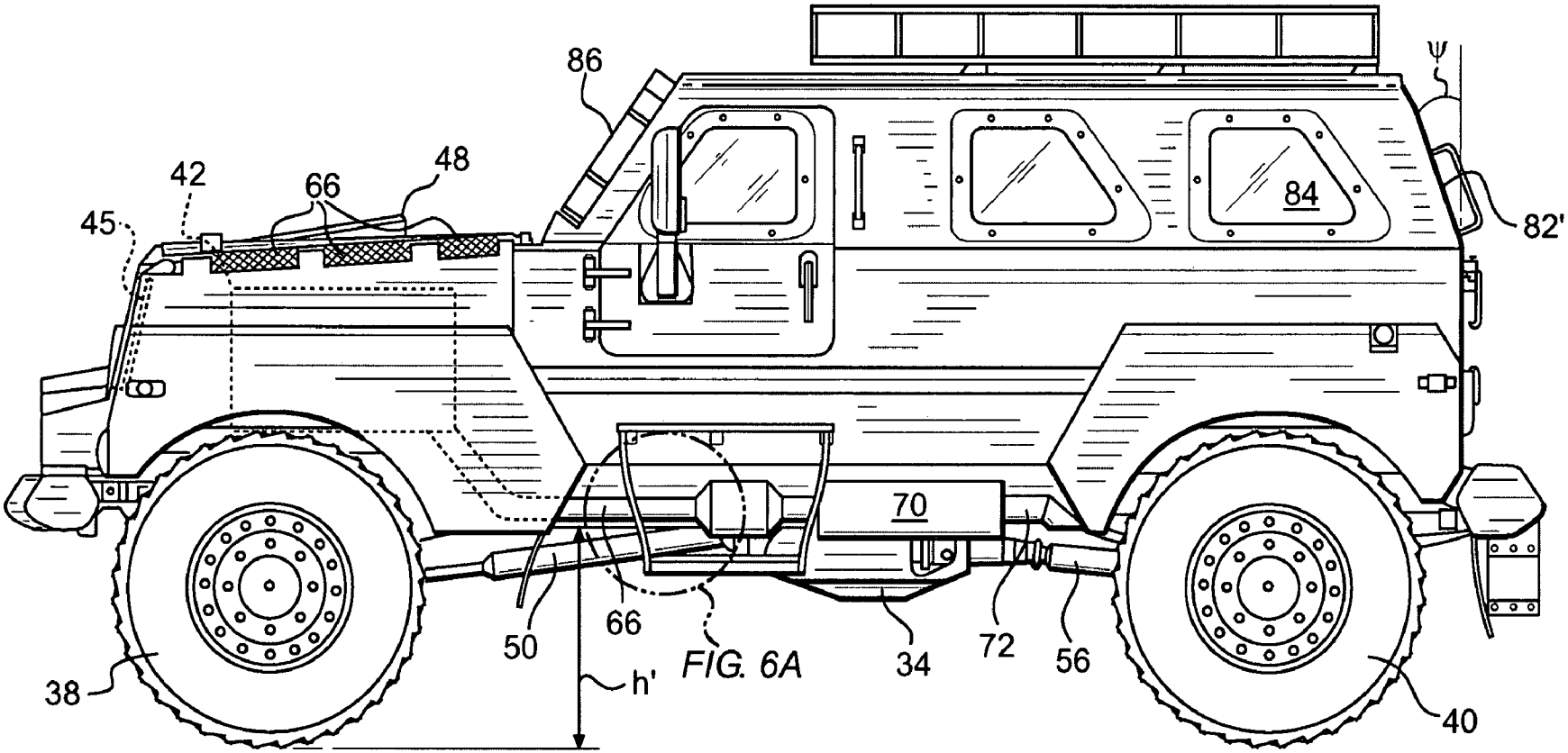
FIG. 6 is a left, side view of a preferred embodiment of the invention.
Figure 6A:
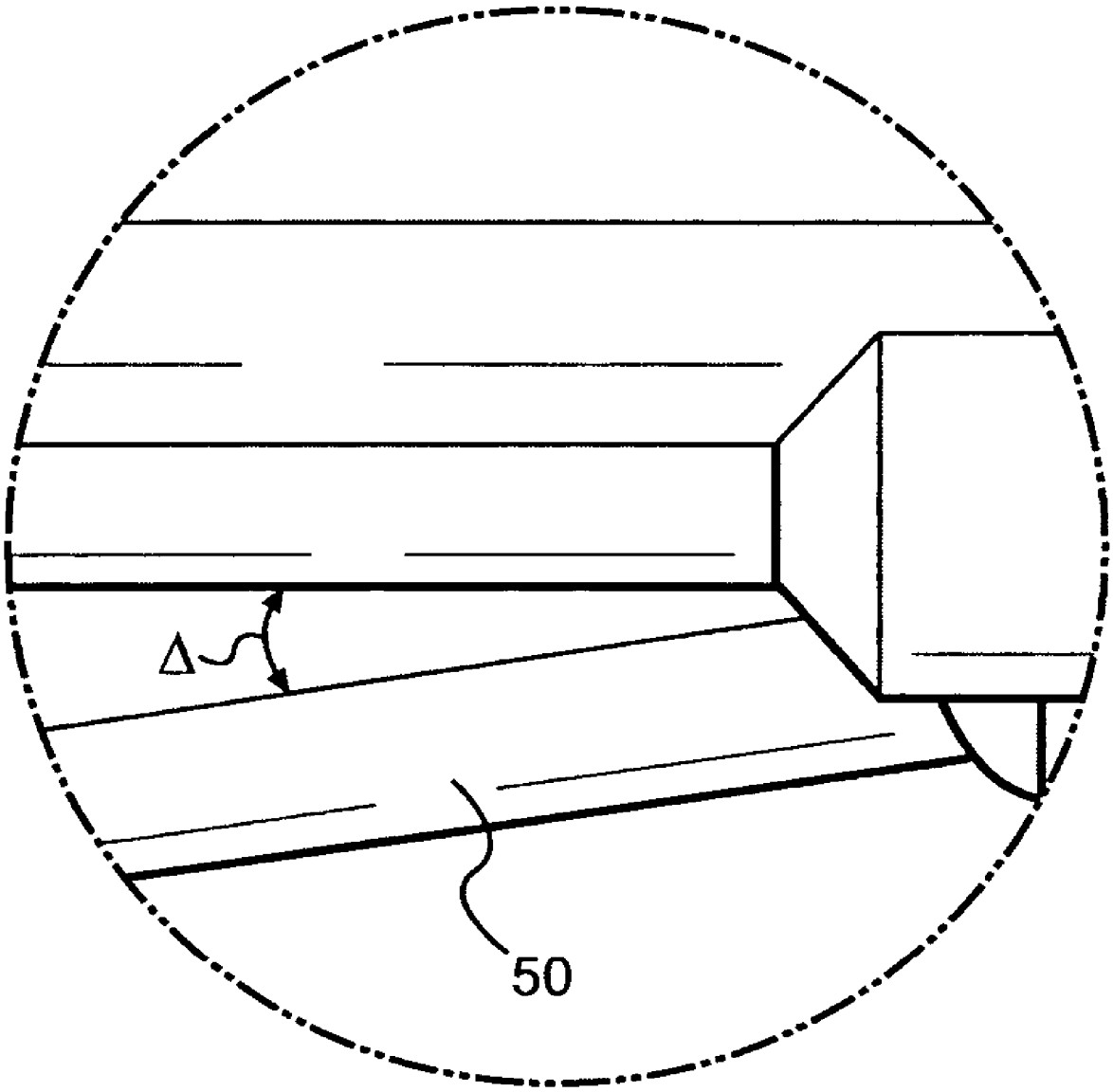
FIG. 6A is a schematic exploded view of a portion of the drive train showing the angular relationship of a drive shaft to the horizon.
Figure 7:
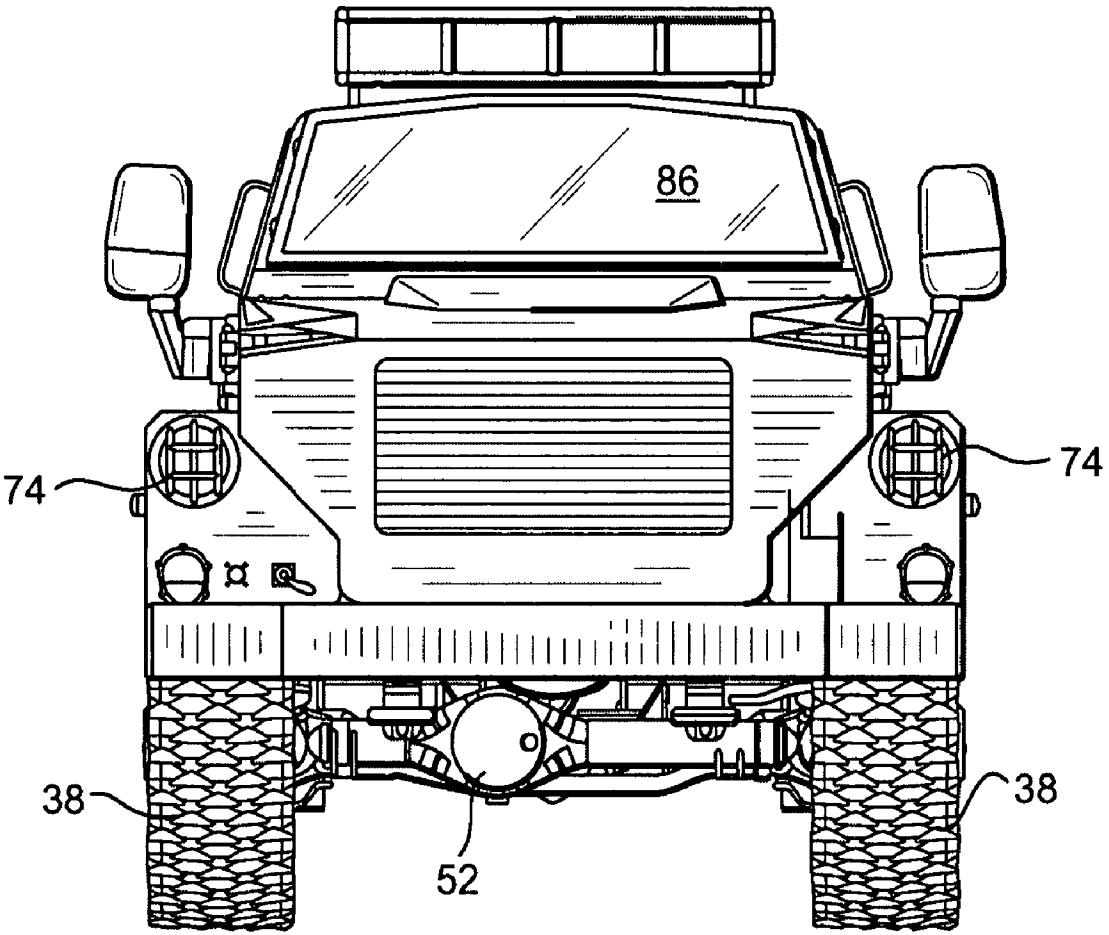
FIG. 7 is a is a front view of a preferred embodiment of the invention.
Figure 8:
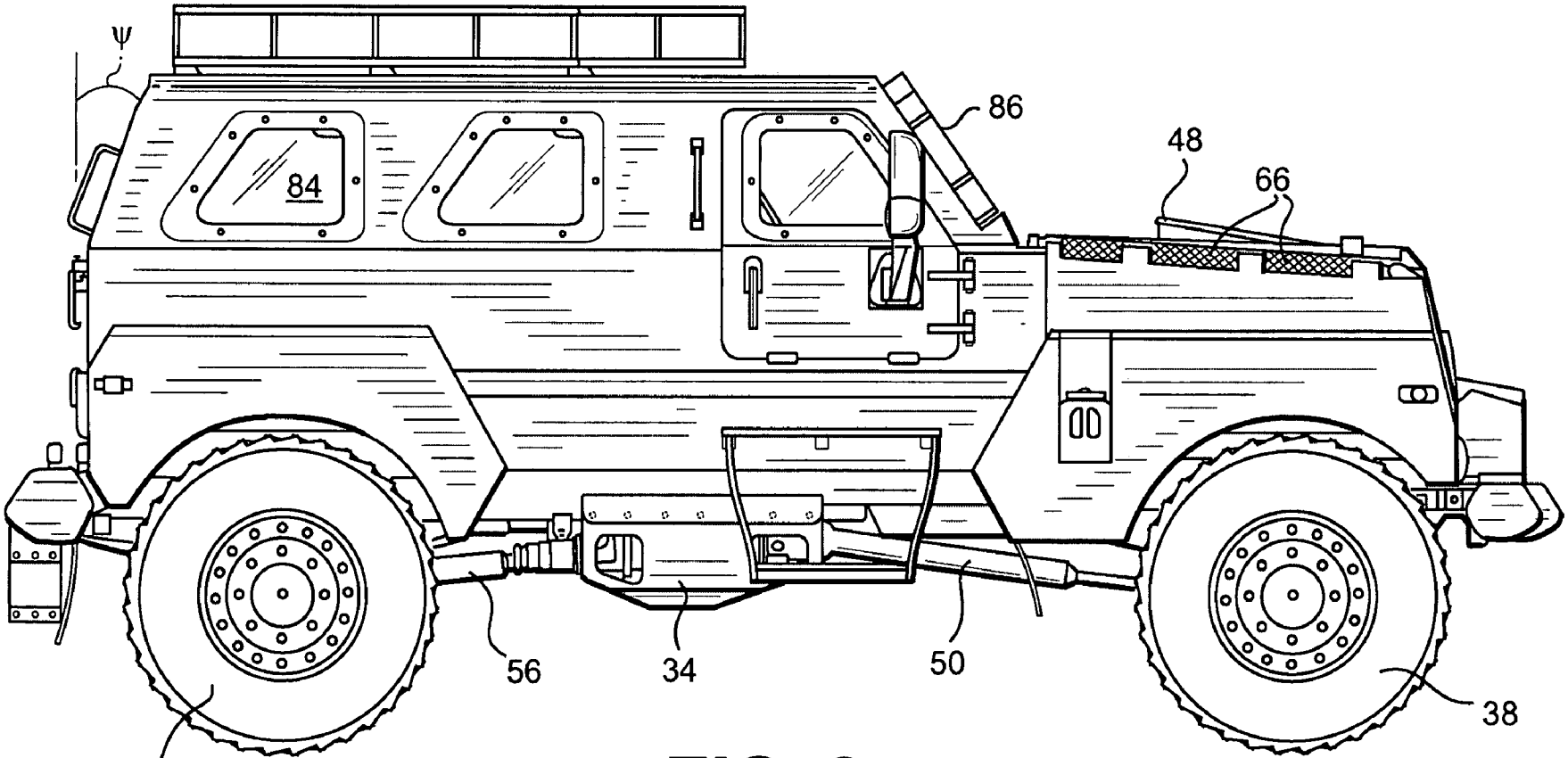
FIG. 8 is a right-side view of a preferred embodiment of the invention.

Preferably, the location of the transfer case is such that the front wheel drive shaft and the rear wheel drive shaft are each at an angle in the range of from 2 to 7 degrees to the front output shaft and the rear output shaft of the front and rear differentials respectively. As is depicted in FIG. 6A, the front drive shaft 50 is schematically shown at an angle Δ of approximately 6° from the lower edge of the vehicle body, which is parallel both to the horizontal direction and the axis of rotation of the input shaft of the front differential 52. While it is not depicted, the output shaft of the transfer case is normally horizontal, thus the drive shafts are preferably at an angle of from 2 to 7 degrees to the output shafts of the transfer case as well. It is the angular relationship of the drive shaft to the input of the differential and output from the transfer case that is significant, not that the drive shaft is any particular angle to the vehicle body or the horizon.

It is further preferred that the distance between the surface on which the vehicle operates and the bottom of the assembly surrounding at least a portion of the transfer case be greater than 17 inches. As here embodied the transfer case armor assembly 34 is approximately 17 inches from the surface on which the vehicle operates. When that distance is less than 17 inches the transfer case armor assembly 34 may contact the ground when the vehicle passes over a ridge to the point that the driven wheels are not in contact with the ground. If the distance is significantly greater than 17 inches the transfer case would be up high with respect to the differentials and it becomes difficult to configure the drive shafts at the appropriate angles without using excessively large wheels.

A front drive shaft 50 transmits power to the front differential 52 which may be mounted on leaf springs 54 and 54', which are in turn mounted to the bottom 18 of the vehicle body 12. Similarly, rear drive shaft 56 transmits power to rear differential 58, which may be mounted on leaf springs 60 and 60' to the bottom of the body 12. The axles of the preferred embodiment disclosed herein are 300 series axles manufactured by Axel Tech of Troy Mich. As here embodied the drive train may be mounted to the armored body 12 on external brackets 62 by pairs of leaf springs 54 and 54', and 60 and 60'. Because the drive components are detachably affixed to the exterior of the monocoque body, if a blast impinges on the drive components, they may be damaged or even blown off the vehicle without the body of the vehicle being breached. Because the drive components are mounted externally, damaged components may be readily replaced by attaching replacement components to the exterior of the damaged vehicle.

As here embodied the vehicle includes the drive train for a heavy duty truck. As used herein, the drive train includes the drive shaft connecting the engine to the transmission, the transmission itself, any shaft connecting the transmission to the transfer case (where a transfer case is used), drive shafts connecting the transmission or transfer cases to the differential(s), the differentials, and the wheels (including the tires and articles) mounted thereon. As here embodied, the vehicle includes differentials 52 and 58 that weigh approximately 1000 pounds each. In addition, the wheel and tires each weigh approximately 500 pounds each. The weight of these components, in combination with the mounting of the engine, transmission, transfer case and drive shafts low in the vehicle, combine to give the vehicle a surprisingly low center of gravity. As here embodied, the vehicle has a center of gravity at or below the floor level of the vehicle of approximately 35 inches. The low center of gravity allows the armored vehicle to have relatively high stability in the roll direction, and in the embodiment depicted the vehicle can remain upright (in the static condition) on a 45° lateral (side to side) incline. It is preferred that the weight of the drive train comprise more than 30% of the loaded gross weight of (with crew and fuel) of the vehicle.

Preferably, the vehicle uses large diameter truck wheels and high profile truck radial tires, preferably greater than 18 inches in diameter. As here embodied, the vehicle uses 20 inch aluminum two-piece wheels with run flats (a concentric insert affixed to the wheel inside the tire that maintains the tire bead on the rim and provides support for the tread even when the tire loses air pressure) manufacture by Hutchinson Industries of Trenton N.J. The tires are high profile heavy truck tires, Michelin XZL tires and the tire size is 365/80R20. At relatively low inflation pressures such wheel and tire sizes provide surprising traction in loose surfaces such as sand and mud. Using low inflation pressure also improves the ride characteristics of the vehicle by effectively reducing the unsprung weight of the vehicle to the weight of the tire tread and a portion of the sidewall of the tire.

The engine cooling system, exhaust system and electrical system may be conventional. As here embodied, the radiator 45 may be behind an armored grill 46 disposed to protect the radiator from projectiles while passing air therethrough. In the embodiment depicted, the vehicle further may include engine compartment vents 66 on either side of the hood 48. The exhaust system exits the engine compartment and, as here embodied, may be along the left side of the vehicle body as the forward exhaust pipe 68 muffler 70, and rear exhaust pipe 72. As here embodied, with the exception of external lights, as for example head lights 74 and 74' and taillights 76 and 76', the electrical system may be within the body 12 of the vehicle 10.

Figure 3A:
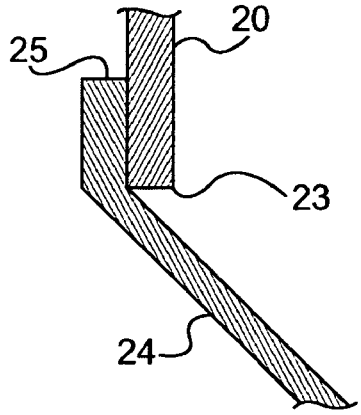
FIG. 3A is a schematic cross-sectional view of a preferred configuration of the joint between the sheet material forming the bottom of the body and the sheet material forming the sides of the body.
Figure 3B:
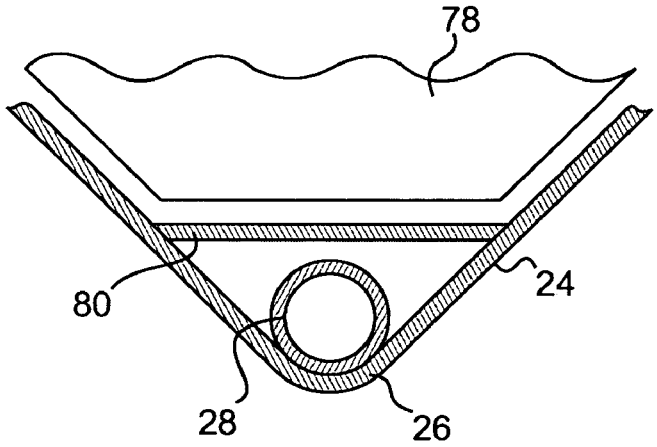
FIG. 3B is a schematic cross-sectional view of an embodiment of a V-shaped bottom with an internal energy absorbing member and armored fuel tank.

In the present embodiment as depicted in FIG. 3B, at least one fuel tank 78 may be mounted within the vehicle body. As here embodied, the fuel tank 78 may be a flexible bladder-type tank mounted within the V-shaped lower portion of the vehicle body and may be protected on its bottom side with sheet armor 80 between fuel tank 78 and bottom 18 of vehicle 10. The extra sheet of armor 80 preferably consists essentially of an aluminum alloy. It is also preferred that the vehicle include sheet armor (not shown) between fuel tank 78 and the interior of vehicle 10. The sheet of armor associated with the fuel tank preferably consists essentially of an aluminum alloy.

Figure 4:
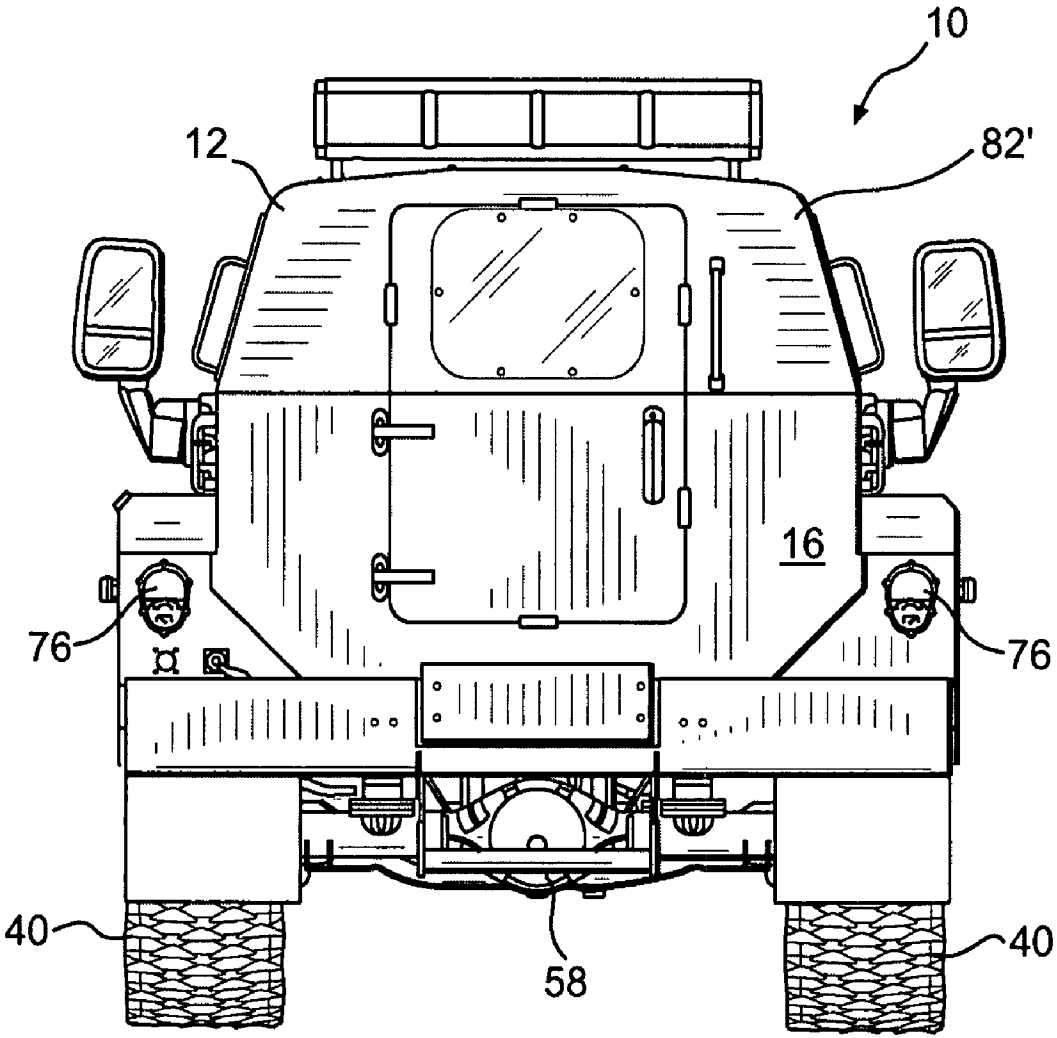
FIG. 4 is a rear view of a preferred embodiment of the invention.

In a preferred embodiment, side portions of the vehicle body may also be configured to deflect blasts from roadside bombs. As here embodied and depicted most clearly in FIGS. 2, 4, and 7, upper portion 82 of the body 12 has a surface at a recumbent angle Ω to vertical. The greater the angle Ω the less efficiently laterally directed blast and material will impinge on the upper portion 82 of the vehicle. The greater the angle Ω, however, the less interior volume is useable. As here embodied, the angle Ω is z. Preferably, the angle Ω is in the range of from z to z. As depicted in FIGS. 4, 6, and 6, the rear end 16 of the body 12 also may include an upper portion 82' at a recumbent angle to the vertical.

In a preferred embodiment, rear of the vehicle body may also be configured to deflect blasts from roadside bombs. As here embodied, and depicted most clearly in FIGS. 6 and 8, upper portion 82' of the body 12 has a surface at a recumbent angle ψ to vertical. The greater the angle ψ the less efficiently laterally directed blast and material will impinge on the upper portion 82' of the rear of the vehicle. The greater the angle ψ, however, the less interior volume is useable. As here embodied, the angle ψ is z. Preferably, the angle ψ is in the range of from z to z.

Figure 3C:
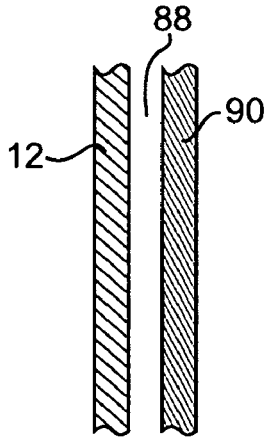
FIG. 3C is a schematic cross-sectional view of an embodiment including an interior projectile absorbing layer.

As here embodied, the vehicle may include armored windows 84 on the sides of the vehicle and an armored windshield 86. It is further preferred that an inner layer of armor, preferably a rigid polymer maxrix composite including a high strength fiber, such as for example, an aramid fiber such as Kevlar® be provided on the interior surface of the body 10, to protect personnel inside vehicle 10, either from any projectiles that still manage to penetrate outer body 12 or any portion of the outer body that induced to spall into the interior of the body. Another preferred embodiment is a layer of high strength fiber (as for example aramid or high strength polyethylene fibers in the from of a woven blanket) adjacent the interior surface of the body. The blanket can be detachably affixed to the interior of the vehicle with hook and loop (Velcro®) fasteners. As here embodied and depicted in FIG. 3C the vehicle body 12 (comprised of armor plate) may include an air space 88 between the vehicle body 12 and the inner layer of armor 90, particularly in the side portions 22, for additional protection from projectile penetration.

In a preferred embodiment the inner layer of armor, comprised of a layer of high strength fiber (here embodied as woven fiber layer 90), further includes ceramic armor plates (not shown) affixed to or placed within pockets in the fiber armor layer.

It will be apparent to those skilled in the art that various modifications and variations can be made to the vehicle of the present invention without departing from the spirit or scope of the invention. Thus, it is intended that the present invention cover all modifications and variations of this invention which fall within the scope of the following claims and their equivalents.

What is claimed is:

1. A blast-resistant armored land vehicle comprising:

a monocoque body comprised of sheet materials, the body having a centerline, a bottom portion, and an upper portion including opposite side portions, the bottom portion defining at least one V, with the apex of the V substantially parallel to the longitudinal centerline of the vehicle, the distance between the surface on which the vehicle operates and the apex of the V being greater than about 30 inches;

an engine detachably affixed within the body;

a transmission connected to the engine;

a transfer case connected to the transmission having a front output shaft and a rear output shaft, the transfer case being proximate the fore and aft center of the vehicle, a drive train assembly connected to the engine, the drive train assembly being detachably affixed to the body wherein the bottom portion further includes a metal energy-absorbing member extending longitudinally along, and affixed to, the interior of the apex of the V.

2. The vehicle of claim 1 wherein the sheet material of the upper body portion consists essentially of steel armor plate with high hardness.

3. The vehicle of claim 1 wherein the sheet material of the bottom body portion consists essentially of steel plate with high fracture toughness.

4. The vehicle of claim 1 wherein the sheet materials of the body consists essentially of sheet metals selected from the group consisting of steel, titanium alloys, and aluminum alloys.

5. The vehicle of claim 1 wherein the sheet materials of the body are comprised of materials selected from the group consisting of: fiber reinforced polymers and metal matrix composites.

6. The vehicle of claim 1 wherein the angle of the V is a compound angle, having more than a single angle, and wherein the angle of the V closest to the centerline of the vehicle is greater than the angle of the V adjacent the sides of the body.

7. The vehicle of claim 1, wherein the energy-absorbing member mounted within the V comprises a metal pipe affixed to the interior of the apex of the V.

8. The vehicle of claim 1 wherein the side portions of the vehicle body have upper side portions with surfaces at a recumbent angle to vertical.

9. The vehicle of claim 1, wherein the body includes a layer of sheet armor adjacent interior surface of the body.

10. The vehicle of claim 9, wherein the sheet armor adjacent the interior surface of the body comprises a rigid polymer/fiber composite.

11. The vehicle of claim 9, wherein the sheet armor adjacent the interior surface of the body comprises a woven fabric comprised of fiber.

12. The vehicle of claim 9, wherein the sheet armor adjacent the interior surface of the body comprises a woven fabric comprised of fiber and a plurality of ceramic plates.

13. The vehicle of claim 9, wherein the sheet armor adjacent the interior surface of the body is spaced from the interior surface to form a gap.

14. The vehicle of claim 1, wherein the side portions comprise hard armor sheet material and the bottom portions comprises tough armor sheet material; the hard armor sheet material of the side portions is joined to the tough armor sheet material of the bottom portion by lap joints; and wherein the bottom portion sheet material is positioned laterally outside of the side portions sheet material at the lap joints.

15. A four wheel drive blast-resistant armored land vehicle comprising:

a monocoque body comprised of sheet material, the body having a centerline, a bottom portion, and a top portion including side portions, the bottom portion defining at least one V, with the apex of the V substantially parallel to the centerline of the vehicle body, the angle of the V being in the range of approximately 115° to 130°, wherein the distance between the surface on which the vehicle operates and the tip of the V being greater than 30 inches;

an engine detachably affixed within the body;

an automatic transmission connected to the engine;

a transfer case connected to the transmission having a front output shaft and a rear output shaft, the transfer case being proximate the fore and aft center of the vehicle, the transfer case being within an enclosure having blast resistant sheet material above the transfer case with an armor assembly surrounding at least a portion of the transfer case;

wherein the vehicle further includes an energy absorbing member mounted within the V comprised of a metal pipe affixed to the interior of the apex of the V.

16. The vehicle of claim 15 wherein the transfer case is within an enclosure having a top side closed with a tough sheet material, the enclosure being open on the bottom.

17. The vehicle of claim 16 wherein the vehicle further includes an assembly surrounding at least a portion of the transfer case, the assembly being disposed to prevent significant blast energy or blast propelled material from entering the transfer case enclosure from the open bottom.

18. A four wheel drive blast-resistant armored land vehicle for operation on a surface, the vehicle comprising:

a monocoque body comprised of sheet materials, the body having a centerline, a bottom portion, and an upper portion including side portions, the bottom portion defining at least one V, with the apex of the V substantially parallel to the centerline of the vehicle body, the angle of the V being in the range of approximately 115° to 130°, wherein the distance between the surface on which the vehicle operates and the apex of the V being greater than about 30 inches, wherein the vehicle further includes an energy-absorbing member mounted within the V comprised of a metal pipe affixed to the interior of the apex of the V.

19. The vehicle of claim 18 wherein the vehicle includes a fuel tank within the body, and wherein the vehicle includes sheet armor between the fuel tank and the metal pipe.

20. The vehicle of claim 19 wherein the vehicle includes additional sheet armor between the fuel tank and the interior of the body, and wherein the additional sheet armor between the fuel tank and the interior of the body consists essentially of an aluminum alloy.

21. The vehicle of claim 18, wherein the sheet material of the upper body portion consists essentially of hardened steel armor plate, and wherein the sheet material of the bottom body portion consists essentially of steel plate with high fracture toughness.

22. The vehicle of claim 18, wherein the tip of the V has a radius in the range of approximately 1 to 4 inches.

23. The vehicle of claim 18, wherein the V is a compound angle, and wherein the angle of the V closest to the centerline of the vehicle is greater than the angle of the V adjacent the side portions.

24. A four wheel drive blast-resistant armored land vehicle comprising:

a monocoque body comprised of sheet materials, the body having a centerline, a bottom portion, and an upper portion, the bottom portion defining at least one V, with the apex of the V substantially parallel to the centerline of the vehicle body, an engine detachably affixed within the body;

a drive train connected to the engine, the drive train being detachably affixed to the body, wherein the drive train includes a front wheel assembly provided at a first location, and a rear wheel assembly provided at a rear location, the first location and the second location being spaced as far apart on the body as is practical, the drive train including a front wheel drive shaft and a rear wheel drive shaft with each of the drive shafts at an angle in the range of from 2 to 7 degrees to the front output shaft and the rear output shaft respectively, wherein the drive train comprises greater than 30% of the gross weight of the vehicle, and wherein the vehicle has a static lateral roll stability on a sloped surface of at least 45°.

25. The vehicle of claim 24, wherein the body includes an interior floor, and wherein a center of gravity of the vehicle is approximately at the height of the floor.

* * * * *